US008540494B2

(12) United States Patent
Chuang

(10) Patent No.: US 8,540,494 B2
(45) Date of Patent: Sep. 24, 2013

(54) FAN STRUCTURE AND STATOR MODULE THEREFOR

(75) Inventor: Chen-Jung Chuang, Taipei County (TW)

(73) Assignee: ADDA Corporation, Pingtung, Pingtung (TW)

( * ) Notice: Subject to any disclaimer, the term of this patent is extended or adjusted under 35 U.S.C. 154(b) by 599 days.

(21) Appl. No.: 12/760,943

(22) Filed: Apr. 15, 2010

(65) Prior Publication Data

US 2011/0255965 A1 Oct. 20, 2011

(51) Int. Cl.
*F01D 25/24* (2006.01)

(52) U.S. Cl.
USPC ..... 417/360; 417/423.1; 415/214.1; 310/254.1

(58) Field of Classification Search
USPC ..... 417/360, 423.1; 415/214.1; 310/254, 310/254.1
See application file for complete search history.

(56) References Cited

U.S. PATENT DOCUMENTS 6,050,785 A * 4/2000 Horng ..... 417/354
2005/0002808 A1 * 1/2005 Huang et al. ..... 417/423.15

* cited by examiner

*Primary Examiner* — Charles Freay
*Assistant Examiner* — Philip Stimpert
(74) *Attorney, Agent, or Firm* — Muncy, Geissler, Olds & Lowe, PLLC

(57) ABSTRACT

A fan structure comprises a stator module and a fan frame, the stator module comprises a fixing plate, an insulating holder, and a stator core. The fixing plate has a first surface, an opposite second surface and at least one fixing portion formed on the second surface and having a first engaging portion. The insulating holder has a first side facing the second surface of the fixing plate, an opposite second side and at least one catching member formed on the first side and having a second engaging portion. The stator core is coupled to the insulating holder. The fan frame has a base, the base is located between the fixing plate and the insulating holder, wherein the first engaging portion of the fixing member is engaged with the second engaging portion of the catching member.

9 Claims, 6 Drawing Sheets

FAN STRUCTURE AND STATOR MODULE THEREFOR

FIELD OF THE INVENTION

The present invention is generally relating to a fan structure, more particularly to a fan structure without adhesive or screws.

BACKGROUND OF THE INVENTION

Referring to FIG. 1, a conventional fan structure 10 typically comprises a base 11, a shaft tube 12 disposed on the base 11, a bearing 13 disposed within the shaft tube 12 and a rotor 14. The rotor 14 at least comprises a pivot 14*a* disposed into the bearing 13 and a fan wheel 14*b*. When the fan structure 10 is assembled via above procedure, it needs an adhesive or screws to fix all components thereby resulting consumptions of manpower and time because of the assembled procedure is too complicated.

SUMMARY

A primary object of the present invention is to provide a fan structure comprising a stator module and a fan frame having a base. The stator module comprises a fixing plate having at least one fixing member, an insulating holder having at least one catching member and a stator core coupled to the insulating holder. The fixing member has a first engaging portion. The catching member has a second engaging member. The base is located between the fixing plate and the insulating holder, wherein the first engaging portion of the fixing member is engaged with the second engaging portion of the catching member. The base is set between the fixing member and the catching member so as to enable the insulating holder and the stator core to be fixed on the base. Because of the first engaging portion of the fixing member is directly engaged with the second engaging portion of the catching member, it enables the insulating holder to be fixed on the fan frame. It doesn't need the adhesive or screws to assemble the fan structure so as to effectively save the manpower and time thereby enhancing the reliability and reducing the fabrication procedure.

DETAILED DESCRIPTION OF THE INVENTION

Figure 1:
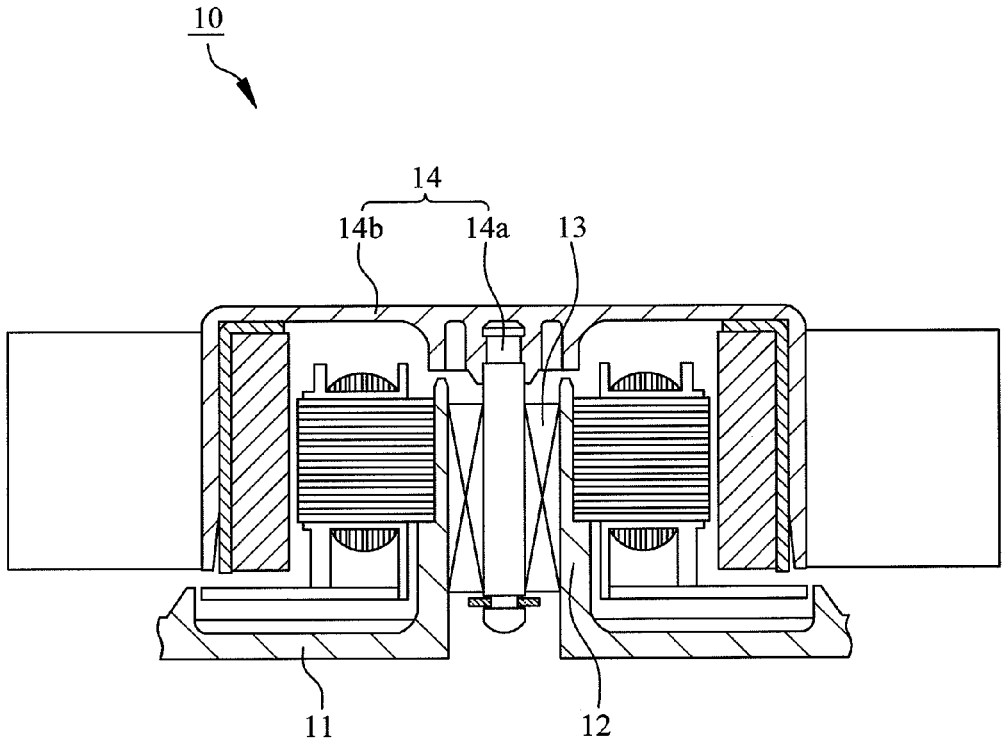
PRIOR ART FIG.1
FIG. 1 is a sectional view illustrating conventional fan structure.
Figure 2:
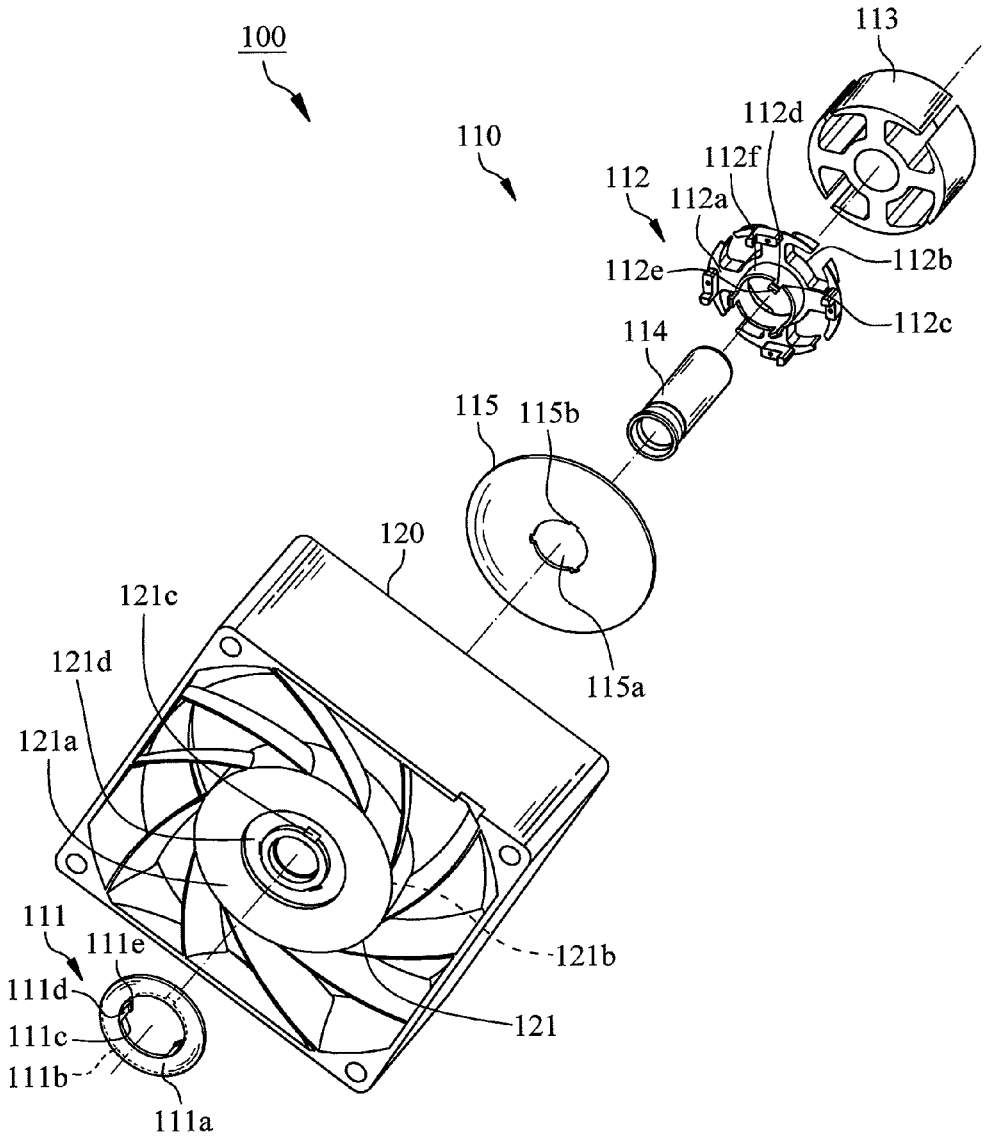
FIG. 2 is a perspective exploded view illustrating a fan structure in accordance with an embodiment of the present invention.
Figure 3:
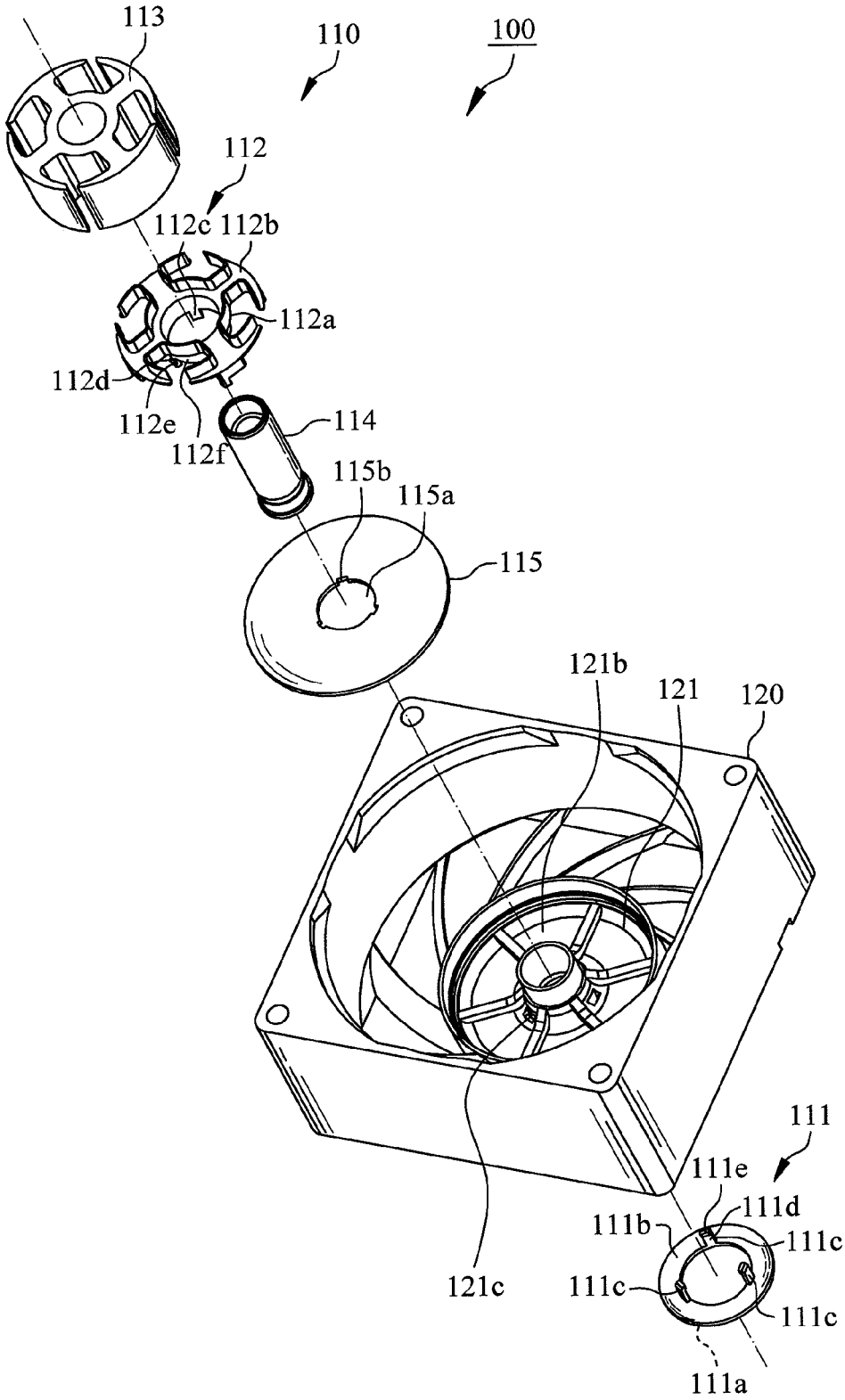
FIG. 3 is another perspective exploded view illustrating a fan structure in accordance with an embodiment of the present invention.
Figure 4:
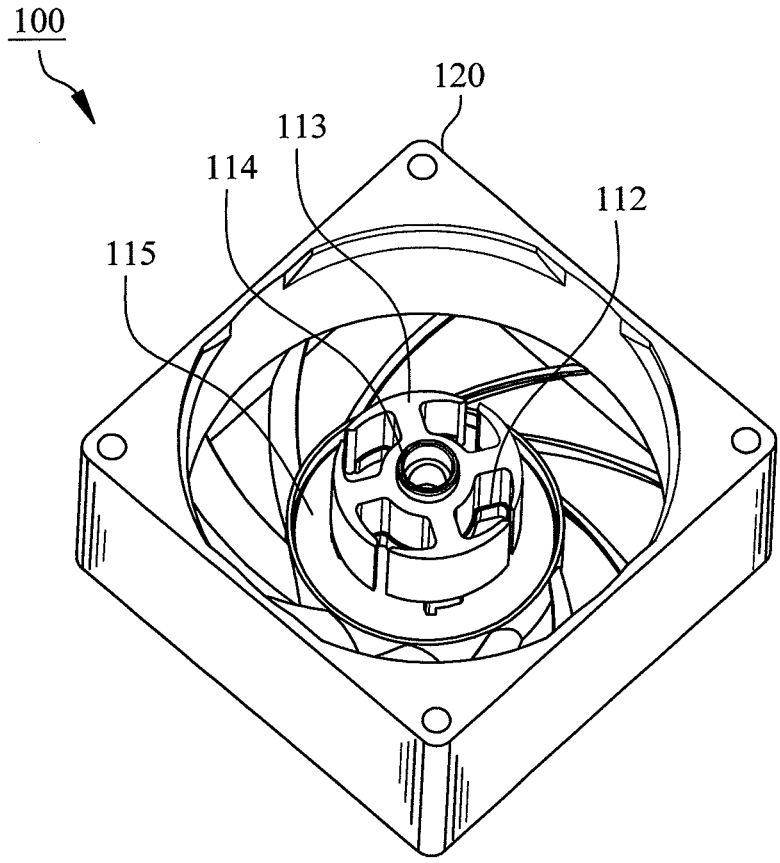
FIG. 4 is a perspective assembly view illustrating the fan structure in accordance with an embodiment of the present invention.

Referring to FIGS. 2, 3 and 4, a fan structure 100 in accordance with an embodiment of the present invention comprises a stator module 110 and a fan frame 120, wherein the stator module 110 comprises a fixing plate 111, an insulating holder 112, a stator core 113, a sleeve 114 and a circuit board 115. The fixing plate 111 has at least one fixing member 111*c*, the fixing member 111*c* could be an aperture penetrated the fixing plate 111 or a recession recessed from the fixing plate 111 or a cylinder protruded to the fixing plate 111. In this embodiment, the fixing plate 111 further has a first surface 111*a* and an opposite second surface 111*b*, and the fixing member 111*c* is the cylinder formed on the second surface 111*b*. The fixing member 111*c* further has a third surface 111*d* and a first engaging portion 111*e*, in this embodiment, the first engaging portion 111*e* protruded from the third surface 111*d* of the fixing member 111*c*. The insulating holder 112 has at least one catching member 112*c*, the catching member 112*c* could be an aperture penetrated the insulating holder 112 or a recession recessed from the insulating holder 112 or a cylinder protruded from the insulating holder 112. In this embodiment, the insulating holder 112 has a first side 112*a* and an opposite second side 112*b*, and the catching member 112*c* is the cylinder formed on the first side 112*a*. The catching member 112*c* has a fourth surface 112*d* and a second engaging portion 112*e*, in this embodiment, the second engaging portion 112*e* protruded from the fourth surface 112*d* of the catching member 112*c*. The first side 112*a* is faced toward the second surface 111*b* of the fixing plate 111. The stator core 113 is engaged with the insulating holder 112.

Referring again to FIGS. 2, 3 and 4, in this embodiment, the insulating holder 112 has a sleeve tube 112*f* protruded from the first side 112*a*, the catching member 112*c* is formed on the sleeve tube 112*f* so as to increase strength of the catching member 112*c* thereby preventing fracture caused by overlength of the catching member 112*c*. The sleeve 114 is disposed into the sleeve tube 112*f* of the insulating holder 112. The circuit board 115 has a through hole 115*a* and at least one opening 115*b*, in this embodiment, the opening 115*b* disposed on the edge of the through hole 115*a* and communicated with the through hole 115*a*. The sleeve 114 penetrates the through hole 115*a*, and the catching member 112*c* of the insulating holder 112 penetrates the opening 115*b*.

Figure 5:
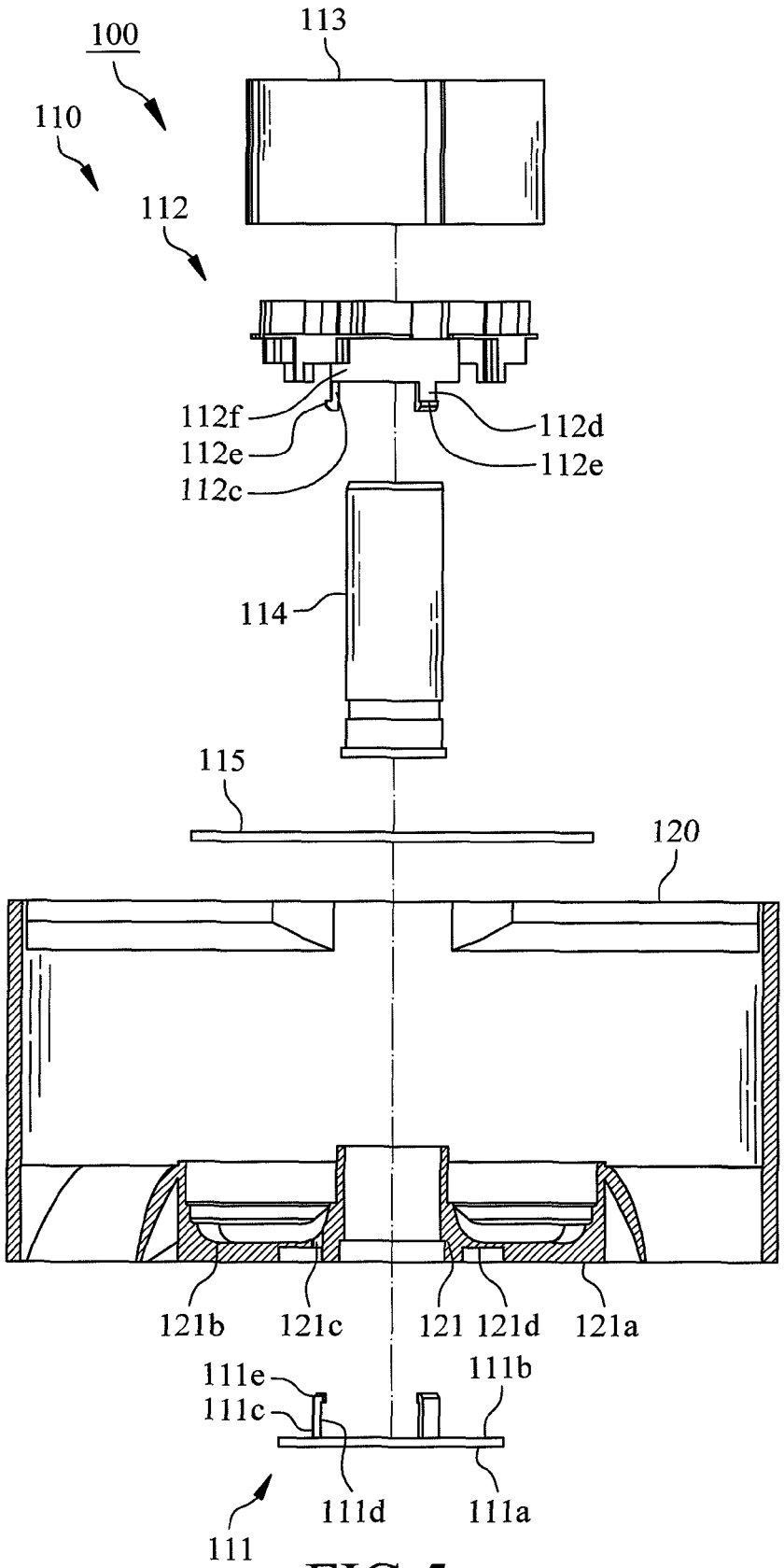
FIG. 5 is a sectional exploded view illustrating the fan structure in accordance with an embodiment of the present invention.
Figure 6:
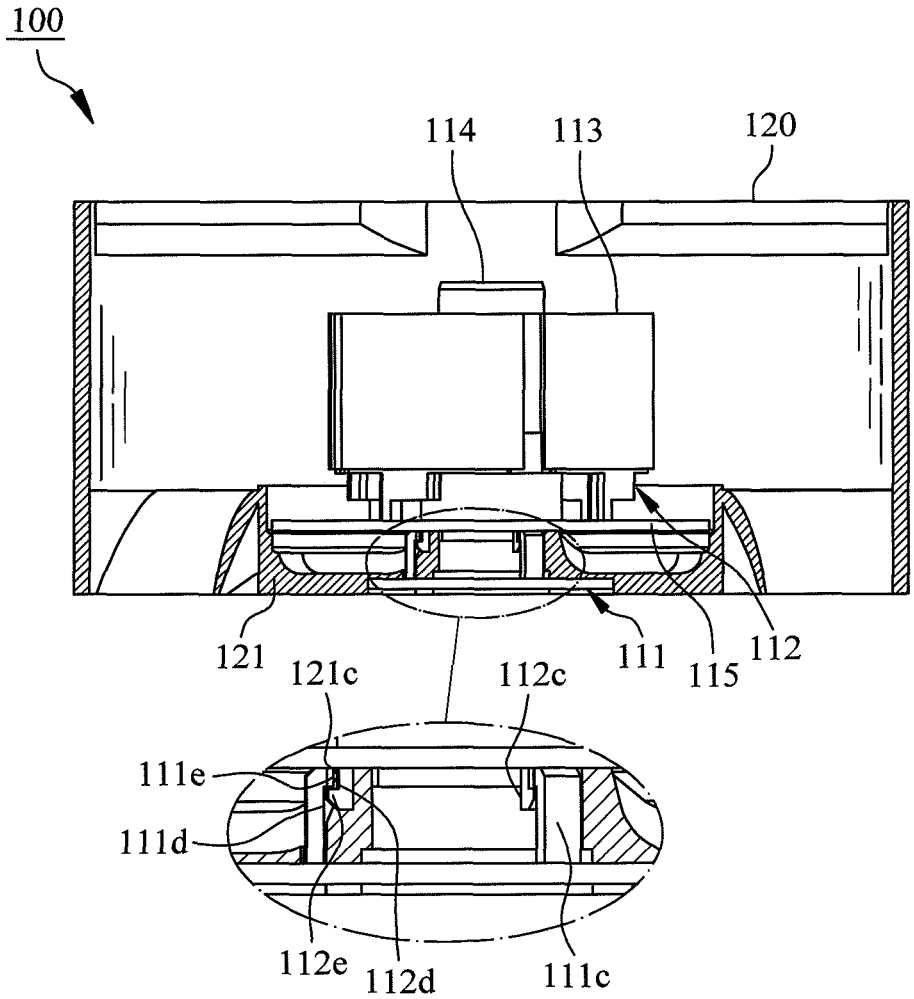
FIG. 6 is a sectional view illustrating the fan structure in accordance with an embodiment of the present invention.

Next, referring to FIGS. 2, 5 and 6, the fan frame 120 has a base 121 located between the fixing plate 111 and the insulating holder 112, wherein the first engaging portion 111*e* of the fixing member 111*c* is engaged with the second engaging portion 112*e* of the catching member 112*c*. In this embodiment, the base 121 has a top surface 121*a*, an opposite bottom surface 121*b* and at least one slot 121*c* in communication with the top surface 121*a* and the bottom surface 121*b*, wherein the top surface 121*a* further has a catching slot 121*d* recessed from the top surface 121*a* and the slot 121*c* is located in the catching slot 121*d*. The second surface 111*b* of the fixing plate 111 of the stator module 110 is faced toward the top surface 121*a* of the base 121 and the fixing plate 111 is disposed on the catching slot 121*d*, wherein the first surface 111*a* and the top surface 121*a* are coplanar. The fixing member 111*c* of the fixing plate 111 penetrates the slot 121*c* so as to enable the first engaging portion 111*e* of the fixing member 111*c* to engage with the second engaging portion 112*e* of the catching member 112*c* to complete the assembly of the fan structure 100. Because of the first engaging portion 111*e* of the fixing member 111*c* is directly engaged with the second engaging portion 112*e* of the catching member 112*c*, it enables the insulating holder 112 to be fixed on the fan frame 120. It doesn't need the adhesive or screws to assemble the fan structure 100 so as to effectively save the manpower and time thereby enhancing the reliability and reducing the fabrication procedure.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A fan structure comprising:

a stator module comprising:

a fixing plate having a first surface, an opposite second surface and at least one fixing member formed on the second surface and having a first engaging portion;

an insulating holder having a first side facing toward the second surface of the fixing plate, an opposite second side and at least one catching member formed on the first side and having a second engaging portion; and a stator core coupled to the insulating holder; and a fan frame having a base, the base is located between the fixing plate and the insulating holder, wherein the first engaging portion of the fixing member is engaged with the second engaging portion of the catching member, wherein the base has a top surface, an opposite bottom surface and at least one slot in communication with the top and bottom surfaces, wherein the fixing member of the fixing plate penetrates the slot, and wherein the stator module further has a circuit board having at least one opening, the catching member penetrates the opening.

2. The fan structure in accordance with claim 1, wherein the fixing member has a third surface, the first engaging portion protrudes from the third surface of the fixing member.

3. The fan structure in accordance with claim 1, wherein the catching member has a fourth surface, the second engaging portion protrudes from the fourth surface of the catching member.

4. The fan structure in accordance with claim 1, wherein the insulating holder has a sleeve tube protruded from the first side, the catching member is formed on the sleeve tube.

5. The fan structure in accordance with claim 4, wherein the stator module further comprises a sleeve disposed into the sleeve tube of the insulating holder.

6. The fan structure in accordance with claim 5, wherein the circuit board has a through hole, the sleeve penetrates the through hole.

7. The fan structure in accordance with claim 6, wherein the at least one opening is in communication with the through hole.

8. The fan structure in accordance with claim 1, wherein the base has a catching slot recessed from the top surface, the fixing plate is disposed within the catching slot.

9. The fan structure in accordance with claim 8, wherein the first surface of the fixing plate and the top surface of the base are coplanar.

* * * * *